US009629490B1

(12) United States Patent
Gheorghe et al.

(10) Patent No.: US 9,629,490 B1
(45) Date of Patent: Apr. 25, 2017

(54) ADJUSTABLE WIDTH GARMENT HANGING DEVICE

(71) Applicants: Samuel Gheorghe, Kingwood, TX (US); Elisabeta Gheorghe, Kingwood, TX (US)

(72) Inventors: Samuel Gheorghe, Kingwood, TX (US); Elisabeta Gheorghe, Kingwood, TX (US)

( * ) Notice: Subject to any disclaimer, the term of this patent is extended or adjusted under 35 U.S.C. 154(b) by 0 days.

(21) Appl. No.: 14/873,925

(22) Filed: Oct. 2, 2015

(51) Int. Cl.
*A47G 25/44* (2006.01)
*A47F 7/19* (2006.01)

(52) U.S. Cl.
CPC ..... *A47G 25/442* (2013.01); *A47F 7/19* (2013.01); *A47G 25/44* (2013.01)

(58) Field of Classification Search
CPC ..... A47G 25/14; A47G 25/16; A47G 25/18; A47G 25/20; A47G 25/26; A47G 25/30; A47G 25/441–25/443; A47F 7/19; F16B 7/10
USPC ..... D6/318, 328
See application file for complete search history.

(56) References Cited

U.S. PATENT DOCUMENTS 2,409,708 A * 10/1946 Rothweiler ..... A47G 25/442 223/90
2,446,312 A * 8/1948 Usina ..... A47G 25/4053 223/89
2,620,102 A * 12/1952 Bremer ..... A47G 25/442 223/89
2,637,471 A * 5/1953 Goldschmidt ..... A47G 25/442 223/89
2,701,083 A * 2/1955 Welker ..... A47G 25/442 223/89
2,716,512 A * 8/1955 Needles ..... A47G 25/442 223/89
2,814,426 A * 11/1957 Miller ..... A47G 25/442 223/94
2,900,117 A * 8/1959 Veltry ..... A47G 25/442 223/94
D320,313 S 10/1991 Gatling
5,344,054 A 9/1994 Nutter
6,409,058 B1 6/2002 Lam et al.
6,637,630 B1 10/2003 Rivenburgh
6,688,503 B2 2/2004 Viazanko et al.
6,811,064 B2 11/2004 Salem
7,077,300 B1 7/2006 Di Pietro
7,328,822 B2 2/2008 Stokes
2010/0038388 A1* 2/2010 Munro ..... A47G 25/32 223/85
2011/0233240 A1 9/2011 Morawietz
(Continued)

*Primary Examiner* — Ismael Izaguirre

(57) ABSTRACT

An adjustable width garment hanging device for adjustable width hanging of garments of varying widths includes a tube with a curved center section. A hook coupled to a center point of the tube defines a pair of arms of the tube. Each of the arms has a plurality of penetrations positioned proximate to a respective opposing end of the tube. Each of a pair of rods is positioned in a respective one of the arms. The rods each have a cavity positioned proximate to a respective straight end. Each of a pair of springs is positioned in a respective one of the cavities. Each of a pair of balls, complimentary to the springs and the penetrations, is in contact with a respective one of the springs. Each of a pair of stops is coupled to a respective one of the opposing ends of the tube.

13 Claims, 3 Drawing Sheets

(56) References Cited

U.S. PATENT DOCUMENTS

2012/0080460 A1* 4/2012 Nance, Jr. ..... A47G 25/442
223/94

* cited by examiner

ADJUSTABLE WIDTH GARMENT HANGING DEVICE

BACKGROUND OF THE DISCLOSURE

Field of the Disclosure

The disclosure relates to garment hanging devices and more particularly pertains to a new garment hanging device for adjustable width hanging of garments of varying widths.

SUMMARY OF THE DISCLOSURE

An embodiment of the disclosure meets the needs presented above by generally comprising a tube with a curved center section. A hook coupled to a center point of the tube defines a pair of arms of the tube. Each of the arms has a plurality of penetrations positioned proximate to a respective opposing end of the tube. Each of a pair of rods is positioned in a respective one of the arms. The rods each have a cavity positioned proximate to a respective straight end. Each of a pair of springs is positioned in a respective one of the cavities. Each of a pair of balls, complimentary to the springs and the penetrations, is in contact with a respective one of the springs. Each of a pair of stops is coupled to a respective one of the opposing ends of the tube.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
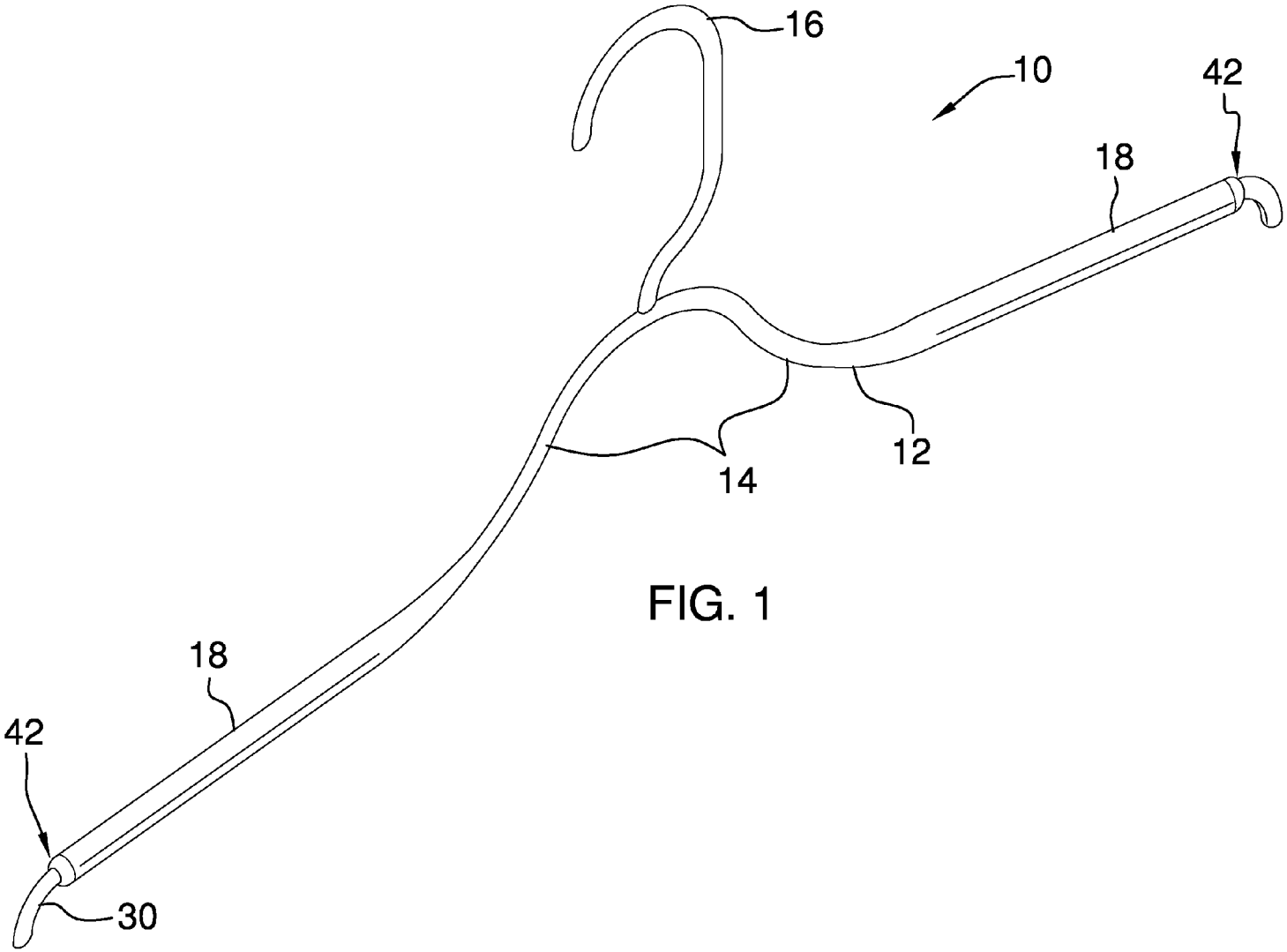
FIG. 1 is an isometric perspective view of an adjustable width garment hanging device according to an embodiment of the disclosure.
Figure 2:
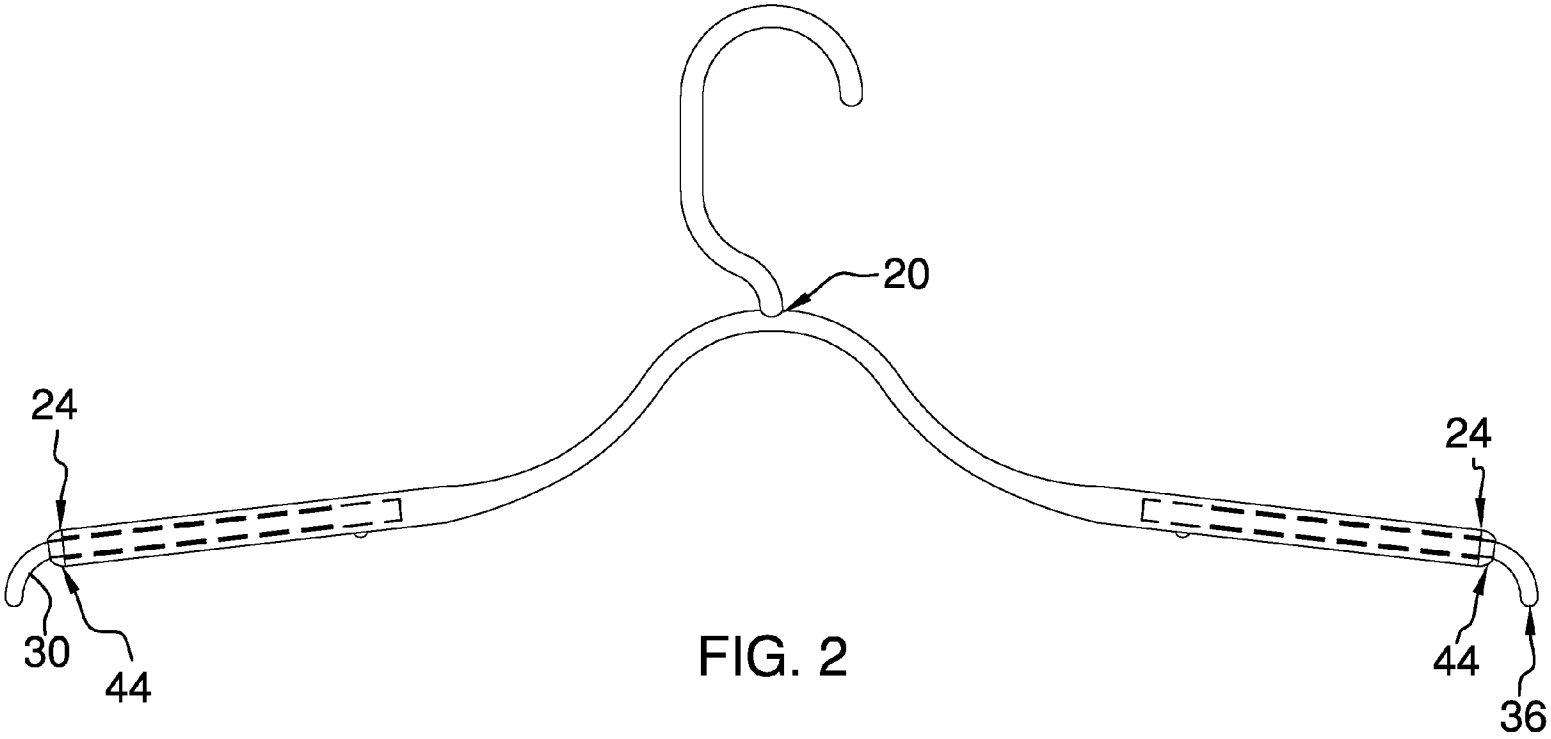
FIG. 2 is a rear view of an embodiment of the disclosure.
Figure 3:
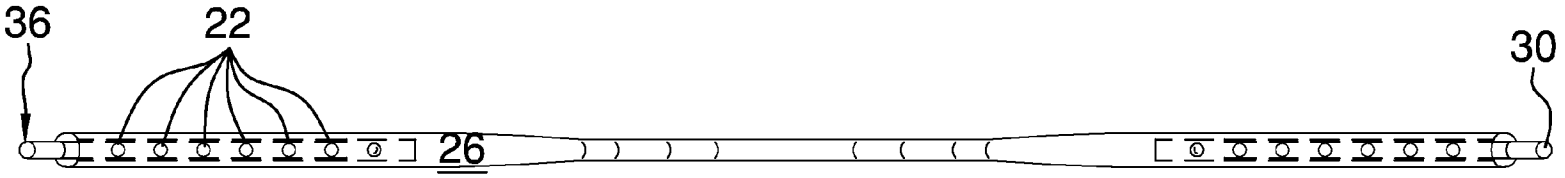
FIG. 3 is a bottom view of an embodiment of the disclosure.
Figure 4:
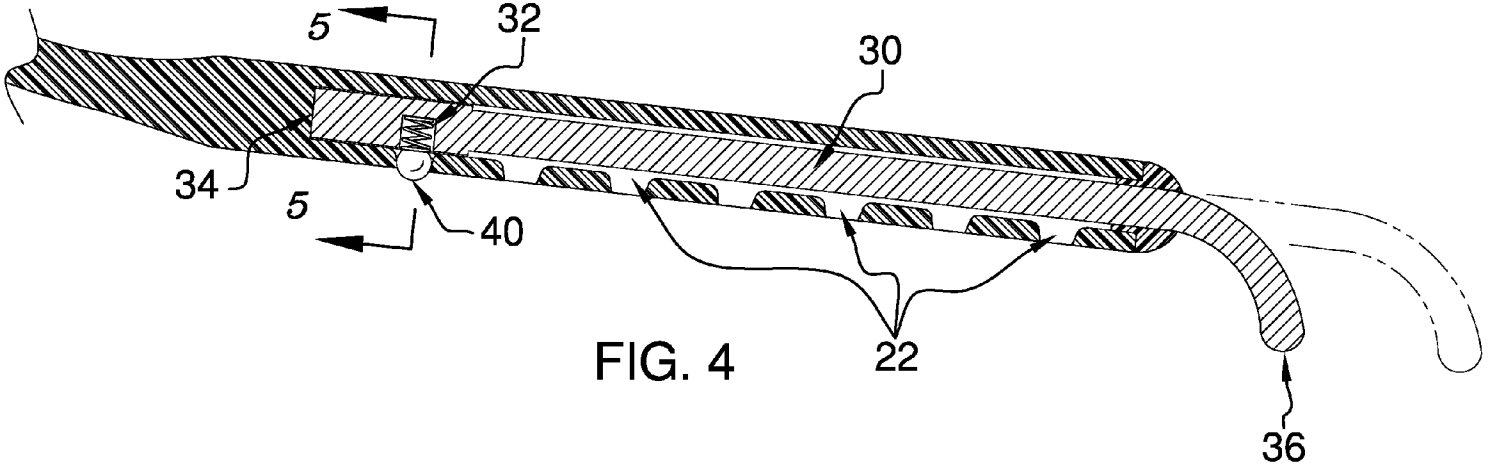
FIG. 4 is a cross-sectional view of an embodiment of the disclosure.
Figure 5:
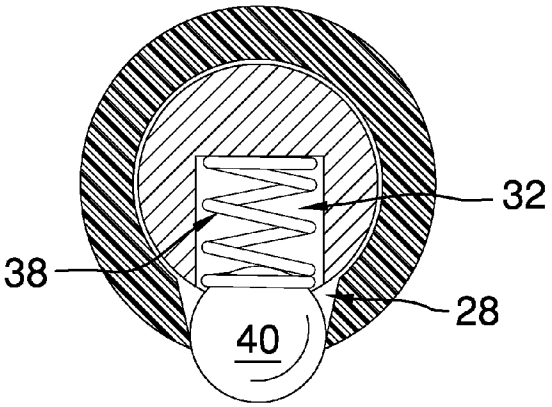
FIG. 5 is a cut-away view of an embodiment of the disclosure.

With reference now to the drawings, and in particular to FIGS. 1 through 5 thereof, a new garment hanging device embodying the principles and concepts of an embodiment of the disclosure and generally designated by the reference numeral 10 will be described.

As best illustrated in FIGS. 1 through 5, the adjustable width garment hanging device 10 generally comprises a tube 12 with a curved center section 14. A hook 16 that defines a pair of arms 18 of the tube 12 is coupled to a center point 20 of the tube 12. Preferably, the hook 16 is rotationally coupled to the center point 20. Each of the arms 18 has a plurality of penetrations 22 positioned proximate to a respective opposing end 24 of the tube 12. The penetrations 22 are positioned in a bottom face 26 of the tube 12. Each of the pluralities of penetrations 22 comprises of between two and ten penetrations positioned linearly. Preferably, each of the pluralities of penetrations 22 comprises between four and eight penetrations positioned linearly. More preferably, each of the pluralities of penetrations 22 comprises six penetrations positioned linearly. The penetrations 22 of each the pluralities of penetrations 22 are spaced at 0.5 to 2.5 centimeters. Preferably, the penetrations 22 of each the pluralities of penetrations 22 are spaced at 0.75 to 1.75 centimeters. More preferably, the penetrations 22 of each the pluralities of penetrations 22 are spaced at 1.27 centimeters.

Each of the arms 18 has a channel 28 that extends between the penetrations 22 of a respective one of the pluralities of penetrations 22. Each of a pair of rods 30 is positioned in a respective one of the arms 18. Each of the rods 30 has a cavity 32 positioned proximate to a respective straight end 34. Each of the rods 30 also has a curved end 36 that extends from the tube 12 transversely to the hook 16. Each of a pair of springs 38 is positioned in a respective one of the cavities 32. The device 10 also comprises a pair of balls 40 that is complimentary to the springs 38 and the penetrations 22. Each of the balls 40 is in contact with a respective one of the springs 38 and positioned in a respective one of the channels 28, such that rotational movement of a respective one of the rods 30 is prevented. Each of a pair of stops 42 is coupled to a respective one of the opposing ends 24 of the tube. The stops 42 comprise a pair of caps 44, with each of the caps 44 coupled to a respective one of the opposing ends 24, such that the stop 42 engages a respective one of the balls 40 to prevent a respective one of the rods 30 from being pulled from the tube 12.

In use, each spring 38 applies pressure to a respective one of the balls 40, engaging the ball 40 in the penetration 22 until pressure is applied to the ball 40 by the user, allowing the rod 30 to be repositioned in the tube 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. An adjustable width garment hanging device comprising:

a tube, said tube having a curved center section;

a hook, said hook being coupled to a center point of said tube, said hook defining a pair of arms of said tube;

each said arm having a plurality of penetrations positioned proximate to a respective opposing end of said tube;

a pair of rods, each said rod being positioned in a respective one of said arms, said rods having a straight end, each said rod having a cavity positioned proximate to a respective straight end;

a pair of springs, each said spring being positioned in a respective one of said cavities;

a pair of balls, said balls being complimentary to said springs and said penetrations, each said ball being in contact with a respective one of said springs; and a pair of stops, each said stop being coupled to a respective one of said opposing ends of said tube, said stops comprising a pair of caps, each said cap being coupled to a respective one of said opposing ends, wherein each said stop engages a respective one of said balls to prevent a respective one of said rods from being pulled from said tube.

2. The device of claim 1, further including said hook being rotationally coupled to said center point.

3. The device of claim 1, further including said penetrations being positioned in a bottom face of said tube.

4. The device of claim 1, further including each of said pluralities of penetrations comprising of between two and ten penetrations positioned linearly.

5. The device of claim 4, further including each of said pluralities of penetrations comprising between four and eight penetrations positioned linearly.

6. The device of claim 5, further including each of said pluralities of penetrations comprising six penetrations positioned linearly.

7. The device of claim 1, further including said penetrations of each said pluralities of penetrations being spaced at 0.5 to 2.5 centimeters.

8. The device of claim 7, further including said penetrations of each said pluralities of penetrations being spaced at 0.75 to 1.75 centimeters.

9. The device of claim 8, further including said penetrations of each said pluralities of penetrations being spaced at 1.27 centimeters.

10. The device of claim 1, further including each said arm having a channel, each said channel extending between said penetrations of a respective one of said pluralities of penetrations.

11. The device of claim 1, further including said rods having a curved end, said curved ends extending from said tube transversely to said hook.

12. The device of claim 11, further including comprising:

each said arm having a channel, each said channel extending between said penetrations of a respective one of said pluralities of penetrations; and each said ball being positioned in a respective one of said channels, wherein rotational movement of a respective one of said rods is prevented.

13. An adjustable width garment hanging device comprising:

a tube, said tube having a curved center section;

a hook, said hook being coupled to a center point of said tube, said hook defining a pair of arms of said tube, said hook being rotationally coupled to said center point;

each said arm having a plurality of penetrations positioned proximate to a respective opposing end of said tube, said penetrations being positioned in a bottom face of said tube; each of said pluralities of penetrations comprising of between two and ten penetrations positioned linearly, each of said pluralities of penetrations comprising between four and eight penetrations positioned linearly, each of said pluralities of penetrations comprising six penetrations positioned linearly, said penetrations of each said pluralities of penetrations being spaced at 0.5 to 2.5 centimeters, said penetrations of each said pluralities of penetrations being spaced at 0.75 to 1.75 centimeters, said penetrations of each said pluralities of penetrations being spaced at 1.27 centimeters;

each said arm having a channel, each said channel extending between said penetrations of a respective one of said pluralities of penetrations;

a pair of rods, each said rod being positioned in a respective one of said arms, said rods having a straight end, each said rod having a cavity positioned proximate to a respective straight end, said rods having a curved end, said curved ends extending from said tube transversely to said hook;

a pair of springs, each said spring being positioned in a respective one of said cavities;

a pair of balls, said balls being complimentary to said springs and said penetrations, each said ball being in contact with a respective one of said springs, each said ball being positioned in a respective one of said channels, wherein rotational movement of a respective one of said rods is prevented;

a pair of stops, each said stop being coupled to a respective one of said opposing ends of said tube, said stops comprising a pair of caps, each said cap being coupled to a respective one of said opposing ends, wherein each said stop engages a respective one of said balls to prevent a respective one of said rods from being pulled from said tube; and wherein each said spring applies pressure to a respective one of said balls, engaging said respective one of said balls in a respective one of said penetrations until pressure is applied to said respective one of said balls by the user, allowing a respective one of said rods to be repositioned in said tube.

* * * * *